United States Patent [19]

Halvorsen

[11] 4,322,893

[45] Apr. 6, 1982

[54] INDEPENDENT INSOLE ASSEMBLY

[76] Inventor: Norrine M. Halvorsen, 169 Sixth St., Rochester, N.Y. 12302

[21] Appl. No.: 136,893

[22] Filed: Apr. 3, 1980

[51] Int. Cl.[3] ..... A43B 13/38; A43B 17/06; A43B 13/18

[52] U.S. Cl. ..... 36/43; 36/3 B; 36/7.8; 36/28

[58] Field of Search ..... 36/28, 29, 3 R, 3 B, 36/7.8, 43, 44

[56] References Cited

U.S. PATENT DOCUMENTS

| | | | |
|---|---|---|---|
| 278,302 | 5/1883 | Wood | 36/43 |
| 507,490 | 10/1893 | Gambino | 36/3 B |
| 1,088,328 | 2/1914 | Cucinotta | 36/28 |
| 1,380,879 | 6/1921 | Young | 36/3 R |
| 1,502,087 | 7/1924 | Bunns | 36/28 |
| 1,517,610 | 12/1924 | Bayless | 36/43 |
| 2,537,156 | 1/1951 | Pennell | 36/43 |
| 2,668,374 | 2/1954 | Seigle | 36/28 |
| 4,187,620 | 2/1980 | Selner | 36/28 |

FOREIGN PATENT DOCUMENTS

| | | | |
|---|---|---|---|
| 1070377 | 2/1954 | France | 36/43 |
| 646346 | 9/1962 | Italy | 36/28 |
| 585531 | 3/1977 | Switzerland | 36/28 |
| 326373 | 3/1930 | United Kingdom | 36/43 |

*Primary Examiner*—James Kee Chi

*Attorney, Agent, or Firm*—Shlesinger, Fitzsimmons & Shlesinger

[57] ABSTRACT

An independent insole assembly embodying an insole attachment member, or both insole and sole attachment members, each of which is integrally formed with depending pegs or clips for connection to spaced resilient means or springs that are interposed between the insole attachment member and a shoe sole, or between the two attachment members in the case where both insole and sole attachment members are used. The assembly is adapted to be incorporated in and connected to a shoe sole and upper during its manufacture and assembly of a shoe thereby to become an integral part of the shoe, with the resilient means or springs projecting upwardly from the shoe sole and resiliently supporting the independent insole assembly thereon. The insole attachment member has a foot-supporting portion and upstanding side portions which embrace the sides and heel of the wearer's foot to protect them from direct friction with the shoe upper during use.

7 Claims, 5 Drawing Figures

INDEPENDENT INSOLE ASSEMBLY

BACKGROUND OF THE INVENTION

This invention relates to a independent spring or suitable resilient insole assembly for incorporation into shoes during the manufacture and assembly thereof.

While it has heretofore been proposed to provide shoe soles with various pneumatic and spring cushioning devices to afford comfort to the wearer, such as those represented in U.S. Pat. Nos. to Freeman 1,021,142, Van Tassell 1,640,302, Cordi 2,413,545, and Stasinos 2,710,460, none thereof provide an independent spring or suitable resilient insole assembly unit adaptable for embodiment in shoes during the manufacture and assembly thereof so as to become an integral component thereof.

SUMMARY OF INVENTION

The principal object of the present invention is to provide an independent insole assembly embodying spaced insole or sole and insole attachment members each having attachment means in the form of depending pegs or clips for interposing spaced springs or suitable resilient members therebetween and connecting the same thereto to form an assembly unit.

Another object is the provision of an independent insole assembly wherein springs or suitable resilient members are attached to an inner surface of a sole attachment member or plate to project vertically therefrom, and the outer ends of the springs or suitable resilient members are attached to an insole attachment member or plate, whereby the attachment members and springs or suitable resilient members constitute an assembly unit for subsequent attachment to a sole and shoe upper during the manufacture and assembly thereof.

A further object is to provide a novel insole assembly of the type described wherein the springs or suitable resilient members are attached at their lower ends directly to a shoe sole rather than to a sole attachment member, and are releasably fastened at their opposite ends to an insole attachment member.

Another object is to provide a novel shoe insole assembly of the type described, and in which the upper member has upstanding sides to avoid friction between the foot and shoe upper during use.

Another object is the provision of an independent insole assembly wherein either or each of the insole and sole attachment members is integrally formed with spaced pegs or any suitable attachment system extending vertically therefrom for fitting within springs or suitable resilient members whereby the attachment members and resilient members are interconnected and constitute an assembly unit for subsequent embodiment in and attachment to a shoe sole during the manufacture and assembly thereof.

These and other objects and advantages will be apparent as the specification is considered with the accompanying drawings, wherein:

FIG. 1 is a side elevational view of a completely manufactured and assembled shoe having an independent insole assembly unit made according to one embodiment of this invention, parts of the shoe and unit being cut away and shown in section, and showing the upper or insole attachment member connected by clips to the upper ends of a plurality of springs, and the lower or sole attachment member having upstanding spring mounting pegs thereon connected to the lower ends of the springs which thus support the upper attachment member resiliently in the shoe;

Figure 1:
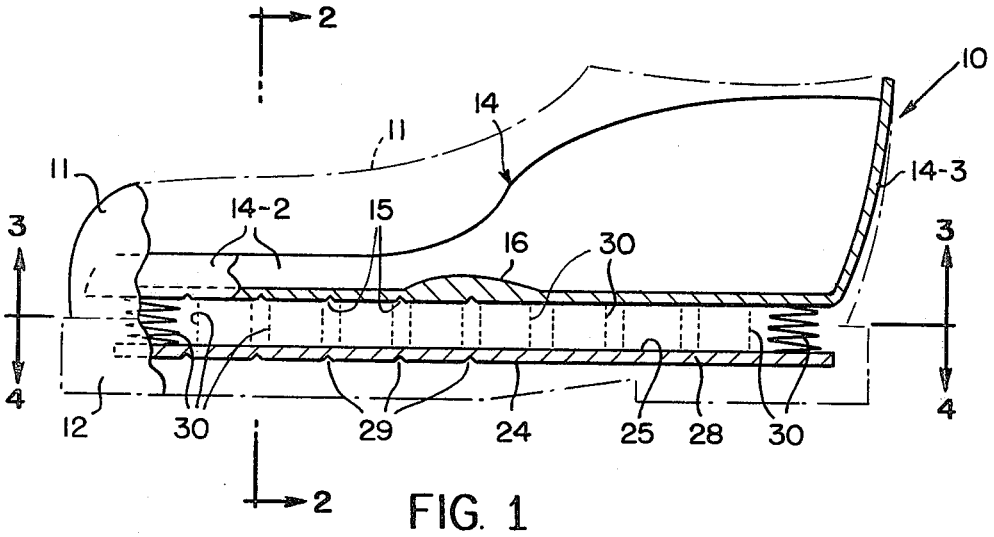
Figure 2:
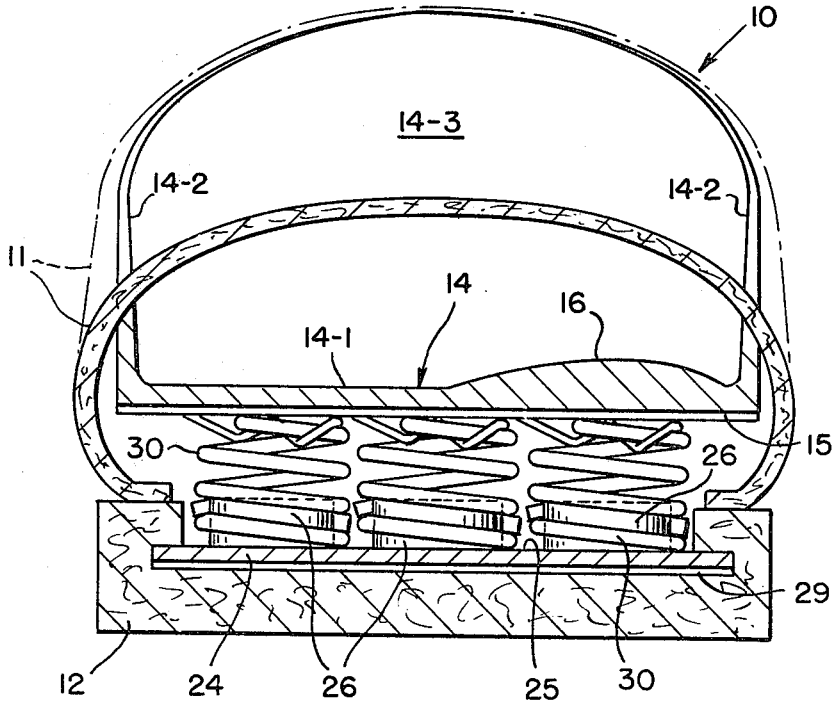
FIG. 2 is an enlarged sectional view taken generally along line 2—2 in FIG. 1 looking in the direction of the arrows.
Figure 3:
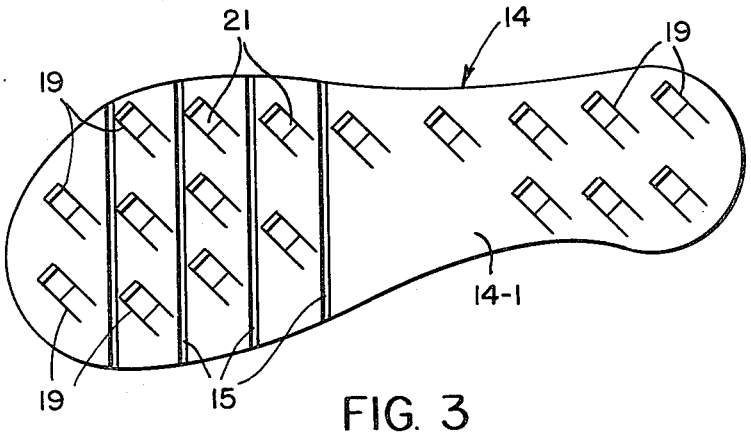
FIG. 3 is a bottom plan view of the insole or attachment member of the insole assembly unit as seen when viewed in the direction indicated by the arrows on line 3—3 of FIG. 1, but with the springs removed.
Figure 4:
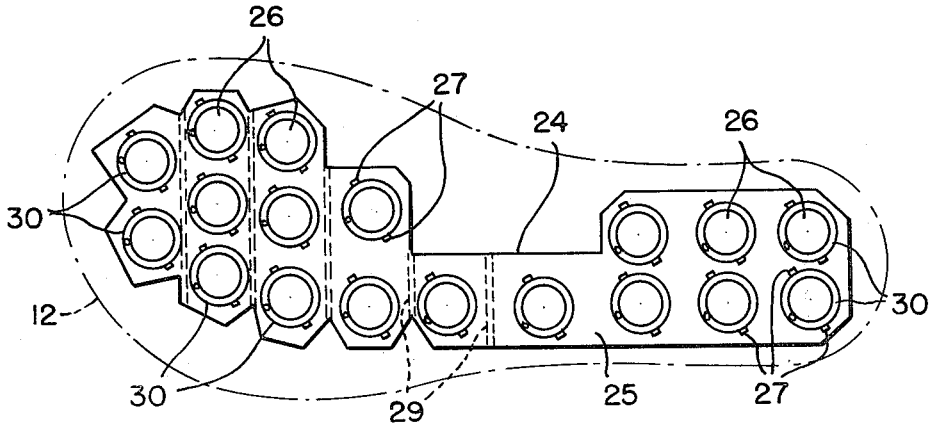
Figure 5:
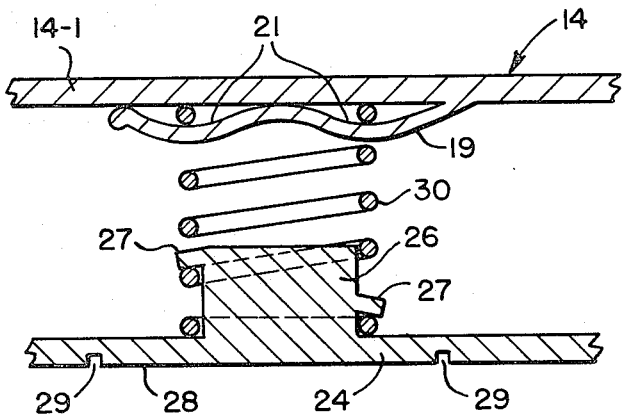

FIG. 4 is a top plan view of the lower or shoe sole attachment member of the insole assembly unit as seen when viewed in the direction indicated by the arrows on line 4—4 of FIG. 1, but with the springs removed; and FIG. 5 is an enlarged fragmentary sectional view taken on a plane extending longitudinally through one of the spring clips as shown in FIG. 1, and illustrating the manner in which opposite ends of each spring are attached to the insole and sole attachment members, respectively.

Referring more particularly to the drawings, wherein similar reference characters designate like parts throughout the several views, number 10 indicates generally a manufactured and assembled footwear shoe. Shoe 10 includes the usual upper portion 11 and sole portion 12, portions of which are cut away and shown in phantom by broken lines. It is to be understood that the structure of the shoe per se, or the manufacture thereof, does not constitute a part of this invention, except that the sole 12 or shoe upper 11 may be modified to accommodate the hereinafter described independent insole assembly unit, so that the latter becomes an integral component of the finished, assembled shoe during the manufacture thereof.

An independent insole assembly unit made according to one embodiment of this invention includes an upper attachment member 14 of suitable material, which is somewhat flexible, and which is contoured to the desired shape of the left or right shoe upper and insole, respectively. Typically member 14 includes a transverse bottom portion 14-1 upon which a wearear's foot is adapted to rest, a pair of upstanding side portions 14-2, and a heel engaging portion 14-3 which is disposed to pass around the heel of the person wearing shoe 10. In addition to being somewhat flexible, upper member 14 may have spaced, transversely extending, parallel, flexure grooves 15 formed in the underside of its bottom 14-1 to enhance flexing thereof in an obvious manner. Moreover, member 14 may be provided with appropriate foot and shoe contours as may be individually required, and as shown by way of example by the instep portion 16 formed on the upper surface of portion 14-1.

Integrally formed in spaced rows on the lower face of portion 14-1 of member 14 to extend intermediate and angularly with respect to the flexure grooves 15, and generally in the direction of foot pressure when walking, is a plurality of spaced clips 19. Each clip 19 is integral at its rear end with member 14, and is indented or corrugagted intermediate its ends as at 21 (FIG. 5) so that its free forward end extends generally parallel to and flexibly abuts lower surface of the member 14. The number of clips 19 may, of course, vary.

Adapted to be spaced below and disposed parallel to the underside of attachment member 14 in the finished shoe 10 is a lower, sole attachment member 24, which as noted hereinafter is optional. This lower member 24 may be made of the same material as member 14, and is so contoured as to be adaptable for mounting on, attachment to, or submersion in the shoe sole 12 as shown by the example illustrated herein. Lower attachment member 24 is integrally and suitably formed on its upper surface 25 with a plurality of spaced rows of spaced, stub pegs 26. In the finished shoe pegs 26 are oppositely disposed and aligned with each of the clips 19 on upper member 14. The pegs 26 are each provided with integral, oppositely, and somewhat downwardly, angularly and radially projecting tabs 27 for a purpose noted hereinafter. The underside 28 of lower member 24 is also formed with spaced, transversely extending, parallel, flexure grooves 29 to enhance flexing thereof, when consolidated in the shoe 10.

Interposed between and interconnected to the upper and lower attachment members 14 and 24 is a series of suitable resilient members which in the embodiment illustrated comprise spaced, vertically disposed, coiled springs 30, which may be of generally standard construction, and which may be spproximately 1 inch in diameter by ½ to ¾ inch in length. There is a spring 30 for each of the oppositely aligned sets of pegs 26 and clips 19. The springs may first be individually connected to each of the clips 19 by laterally sliding the uppermost convolutions thereof over a clip as shown in FIG. 5 until the upper end of the spring is clamped thereby against the underside of member 14. After each spring is so mounted, and the springs are positioned over and aligned with each of the stud pegs 26, the application of downward pressure on section 14-1 will push the lowermost convolutions of each spring 30 over and past the tabs 27 on the pegs and against the upper surface 25 of lower plate 24. The tabs will flex downwardly during the passage of the lowermost convolutions thereby, and then spring back to their normal extended positions overlapping the lowermost convolutions so as to clamp each spring to the lower plate or member 24. When the springs are so assembled and connected to the upper and lower members 14, 24, it will be evident that the combined members, with interposed springs, will constitute a composite insole assembly unit. Also note that, due to the same angular pattern of the clips 19, that the springs may be pushed down on to the pegs 26, firstly, and then the upper member 14 may be slid on the upper ends of springs 30 in one movement of corresponding angle.

Such an insole assembly unit may be suitably inserted in, or otherwise mounted on, sole 12 and be fixed thereto. For example, in the event injection molding equipment is being utilized to produce the shoes, such an insole assembly unit could be applied during the molding process so that the lower plate 24 could be submerged in and the soft heated sole material will cover the plate and the lowermost convolutions of the springs. Thus, upon cooling of the sole material, the sole attachment member 24, and consequently the assembly unit itself will be securely anchored in and secured to the sole, in an obvious manner. However, it is to be understood that the insole assembly units may be otherwise suitably mounted on and assembled relative to the shoe soles. The lowermost edges of the shoe upper may then be suitably secured to the sole, and the usual shoe insole, if a separate insole is used, may then be superposed on and applied to and suitably attached to the upper face the transverse section 14-1 of the member 14 so that the composite insole assembly unit will be fully and securely embodied with the finished and assembled shoe.

When walking, the member 14, or if both insole and sole attachment members are employed, the members 14 and 24, will flex together with the sole, and the springs 30, or other resilient means employed, will be compressible and will create an independent suspension system, which will reduce shocks on the feet of the wearer during active use of shoes embodying the novel insole assembly. In this connection, when the springs 30 are used, their rates are preferably determined according to various weight ranges, so as to have approximately 30% compression at standing weight, and 70% reserve compression for walking and related foot-shocking conditions. The portions 14-2 and 14-3 of member 14 prevent undesirable foot friction between the upper 11 and the foot of the wearer.

If desired, suitable vent holes, not shown, may be provided, adjacent the juncture between independent insole members and sole members to permit air circulation between the members, and thereby to prevent or minimize excessive foot prespiration.

It will be understood that, in forming the insole assembly units, the member 14 and 24 may be interchanged and otherwise arranged, so that the member with clips 19 thereon and the member with stud pegs 26 thereon may be reversed from that shown in FIGS. 1-4. Moreover, if desired, both attachment members may be similarly provided with opposing clips, or with opposing pegs. Of course other suitable means of attaching and supporting the independent insole to appropriate resilient material may be apparent to one skilled in the arts, and may be attached to combined with the shoe sole to provide a means of creating an independent insole assembly.

While this invention has been illustrated and described in connection with only certain embodiments thereof, it will be apparent that it is capable of still further modification and that this application is intended to cover any such modification and that this application is intended to cover any such modifications that may fall within the scope of one skilled in the art or the appended claims.

What I claim is:

1. An insole assembly unit, for embodiment in an article of footwear including a sole and a shoe upper, comprising a semi-flexible insole attachment member disposed to form at least the foot-supporting portion of the insole of a shoe, a second, semi-flexible attachment member spaced from said insole attachment member and disposed to be secured to the sole of a shoe, a plurality of spaced, resiliently compressible elements secured to and extending between said members, and means for securing said second member to the sole of a shoe whereby said elements support said insole attachment member movably and resiliently above said sole in a finished shoe, one of said members having thereon spaced multiple clip means integrally arranged on a surface opposed to the other member, and said other member having thereon spaced, multiple, vertically disposed integral peg means aligned with and opposed to said clip means, and each of said resilient elements being releasably attached at one end to one of said clip means and being sleeved at its opposite end over one of said peg means, whereby said elements are disposed between and interconnect said attachment members.

2. An insole assembly unit as defined in claim 1, wherein said insole attachment member has upstanding side portions projecting upwardly from the foot-supporting portion thereof and contoured to protect the heel and sides of a foot from direct friction with the shoe upper during use of the unit in a finished shoe.

3. An insole assembly unit according to claim 1, wherein said attachment members are generally contoured as said sole and shoe upper and are disposed to be interfitted therewith, respectively.

4. An insole assembly unit according to claim 1, wherein said spaced clip means and peg means are arranged in accordance with the weight and contour requirements of a shoe, and generally in spaced rows.

5. An insole assembly unit according to claim 1, wherein said resilient elements are coil springs and each of said clip means is indented for flexibly interengaging at least the outermost convolution at said one end of each of said coil springs for clamping that end to the associated attachment member.

6. An insole assembly unit according to claim 5, wherein each of said peg means is cylindrical and has radially projecting integral flexible tabs adjacent the outer end thereof, whereby when a coil spring is sleeved thereover said tabs will inter-engage the end convolutions of said spring to connect the spring to the associated attachment member.

7. An insole assembly unit according to claim 1, wherein said attachment members are formed with spaced, transversely extending flexure grooves formed in a downwardly disposed face of each member.

* * * * *

UNITED STATES PATENT OFFICE

CERTIFICATE OF CORRECTION

Patent No. 4,322,893 Dated April 6, 1982

Inventor(s) Norrine M. Halvorsen

It is certified that error appears in the above-identified patent and that said Letters Patent are hereby corrected as shown below:

On the title page, in line 2 of the paragraph denoted by [76], the postal zone number "12302" should read --14605--.

Signed and Sealed this

*Twenty-second* Day of *June 1982*

[SEAL]

*Attest:*

GERALD J. MOSSINGHOFF

*Attesting Officer*

*Commissioner of Patents and Trademarks*